US005358061A

United States Patent [19]

Van Nguyen

[11] Patent Number: 5,358,061

[45] Date of Patent: Oct. 25, 1994

[54] SEAL PROTECTION FOR ROCK BITS

[75] Inventor: Quan Van Nguyen, Houston, Tex.

[73] Assignee: Smith International, Inc., Houston, Tex.

[21] Appl. No.: 141,298

[22] Filed: Oct. 21, 1993

[51] Int. Cl.[5] ..... E21B 10/00

[52] U.S. Cl. ..... 175/371

[58] Field of Search ..... 175/371, 372, 359, 331, 175/337, 339

[56] References Cited

U.S. PATENT DOCUMENTS 2,960,313 11/1960 Goodwin .
3,013,621 12/1961 Kinnear .
3,656,764 4/1972 Robinson ..... 175/371 X
4,478,299 10/1984 Dorosz ..... 175/371 X
5,056,610 10/1991 Oliver et al. .
5,080,183 1/1992 Schumacher et al. ..... 175/371

*Primary Examiner*—Michael Powell Buiz
*Attorney, Agent, or Firm*—Robert G. Upton

[57] ABSTRACT

Sealed bearing roller cone rock bits are prone to seal wear and failure due to the encroachment of abrasive drill cuttings into the seal gland. A hard metal cuttings diverter pad angularly positioned across the bit leg backface, adjacent the trailing edge of the leg shirttail edge, wipes the accumulated drill cuttings from the rotating cone backface. A circumferential groove, formed in the bit leg backface, promotes a relatively high volume flow of drilling fluid at the seal gland entrance to flush away the abrasive cutting particles not diverted by the hard metal diverter pad.

12 Claims, 2 Drawing Sheets

SEAL PROTECTION FOR ROCK BITS

BACKGROUND OF THE INVENTION

I. FIELD OF THE INVENTION

This invention relates to rotary cone drill bits and a means to prevent drill cuttings from entering the bearings.

More particularly, this invention provides a drilled cuttings diverter or barrier in conjunction with a circumferential groove on the backface of the bit leg.

II. DESCRIPTION OF THE PRIOR ART

It has long been recognized in the drill bit industry that the longevity of sealed bearing rotary cone drill bits is greatly increased if debris is prevented from entering the bearings associated with each of the rotary cones rotatively retained on the legs of a drill bit. Drill bits used in carrying out rotary drilling are subject to destruction by erosion caused by the abrasive effect of the rock detritus entrained in the drilling fluid. Fluid circulation is employed primarily to circulate or flush the debris or formation cuttings from the well bore. In actual practice, mud and solids from the circulating fluid and from the earthen formations pack onto certain portions of the bit structure. This packed material flows or extrudes and moves relative to certain portions of the bit. Since great pressures are utilized in the drilling operations, the movement or flow of this packed material has adverse effects on the bit structure and, in particular, the seal cavity, the seal and bearings associated with each rotary cone of the bit.

U.S. Pat. No. 2,960,313 addresses the foregoing problem. A means is provided to mechanically deflect mud and cuttings from a path that normally results in wear and destruction of a roller cone bit. A deflecting post or pin is provided in the leg backface. The end of the pin is adjacent a cone backface; the pin serving to deflect detritus or debris as it invades the space between the cone backface and the leg backface. The pin is fixed in the leg backface and has an exposed cylindrical end that terminates in a flat surface, the flat surface paralleling the rotary cone backface.

The deflecting post, while being somewhat effective in intercepting the flow of debris, its circular shape can divert debris and fluid towards a seal cavity thus allowing some debris to enter this cavity.

U.S. Pat. No. 3,013,621 describes a means to deflect abrasive particles or cuttings from the space formed between a leg backface and a conical cutter. An overlay of hardened materials is welded to the leg backface at an angle to a radial plane from a journal center line. The abrasion resistant material metallurgically attached to the leg backface serves to scrape or divert debris away from the cone bearings to prevent the debris from entering and destroying the bearing during operation of the bit in a borehole.

This means of diverting the fluid and accumulated cuttings is somewhat ineffective because the space between the leg backface and the cutter backface is very restricted. Therefore, a minimal volume of drilling fluid can be circulated between the cone and the leg backface to flush away the abrasive drill cuttings. This allows intimate contact of the abrasive cuttings with the seal gland promoting premature seal and bearing failure.

U.S. Pat. No. 5,056,610, assigned to the same assignee as the present invention, describes a roller cutter bit having a drill cuttings diverter means to prevent packing and abrasion of the bearing seal gland. This diverter means consists of a burn plug positioned in the leg backface that is energized to force the plug into contact with the roller cone backface to wipe clean the face proximate the seal gland.

Although this system initially does remove the build-up of detritus at the seal gland area, the hard metal burn plug wears a circumferential groove in the cone backface proximate the seal fairly rapidly, exposing the seal to more abrasive cuttings, thereby accelerating seal wear. A significant amount of heat is generated by the plug wearing a groove in the cone, which at times deteriorates the seal.

The present invention has an advantage over the above prior art mechanisms in that the leg backface surface is a recessed circumferential groove instead of a flat surface. A hard abrasive resistant shale diverter pad is affixed fully across the leg backface groove at an angle that is approximately tangent to the seal gland outer diameter so that the outer edge of the pad angles into the direction of the rotation of the cone. The diverter pad wipes the accumulated detritus from the roller cone heel area and the adjacent circumferential groove in the leg backface allows a significantly more than normal volume of drilling fluid to continuously flush the seal gland area clean of cuttings and other detritus.

SUMMARY OF THE INVENTION

It is an object of the present invention to provide a means to prevent debris from entering and destroying the seal and bearings formed by the rotary cone and its journal.

It is another object of the present invention to provide a means in the form of a hard metal pad welded on the backface of the bit leg backface to wipe off the accumulated formation cuttings or shale packing on the backface of the rotary cone. The hard metal wiper pad blends into the hard metal formed on the lower outer surface of the shirttail to ensure the pad is not undercut by erosion and abrasion to render it ineffective.

It is still another object of the present invention to provide a circumferential groove on the leg backface to allow a larger than normal volume of drilling fluid to pass between the leg backface and the cutter backface to flush away the detritus from the seal cavity.

The foregoing objects are achieved by providing a sealed bearing rotary cone drill bit having a body that forms a first pin end and a second cutting end. A downward extending leg forms an outer surface and a journal bearing integrally formed with the leg and projecting inwardly therefrom. A circumferential groove is formed at the juncture of the journal bearing and the leg. A cutter is rotatively mounted on the journal bearing. The cone forms a backface that is adjacent to the groove formed on the leg. The circumferential groove and the cone backface are normal to a rotary axis of the cone. The leg further forms an angled raised pad of hard, abrasion resistant metal that intersects and closes the circumferential groove at its trailing end in relation to the direction of rotation of the cone. The hard metal pad also ties into the hard metal on the outer surface of the shirttail.

A rotary cone rock bit apparatus is disclosed that minimizes the intrusion of detritus into the bearing cavity formed between a bearing and a rotary cone of the rock bit.

A rock bit body forms a first pin end and a second cutting end. At least one leg extends from the body toward the second cutting end of the bit. The leg rotatively supports the rotary cone from a bearing journal that is cantilevered from the base of the leg. A leg backface is formed by a shirttail formed at the base of the leg. The backface is positioned adjacent a cone backface formed by the rotatable cone. The leg backface in the shirttail portion forms an enlarged fluid passageway between the leg and the cone backface adjacent the bearing cavity. The enlarged passageway provides a means to allow fluid to flush the detritus from the bearing cavity during operation of the rock bit in an earthen formation.

It should be obvious that the present invention may be beneficial to open non-sealed rock bit bearings also by preventing the drilled cuttings from entering the bearing cavity thereby increasing the bearing life.

An advantage then of the present invention over the prior an is that the hard metal pad acts as a barrier and prevents the large particles of formation cuttings from going between the cone and leg backface and the greater volume of fluid in the groove scavenges the smaller abrasive particles from the bearing seal interface.

Yet another advantage of the present invention over the prior art is the means whereby the larger fluid volume in the groove serves to better cool the seal and bearing for longer bit life.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
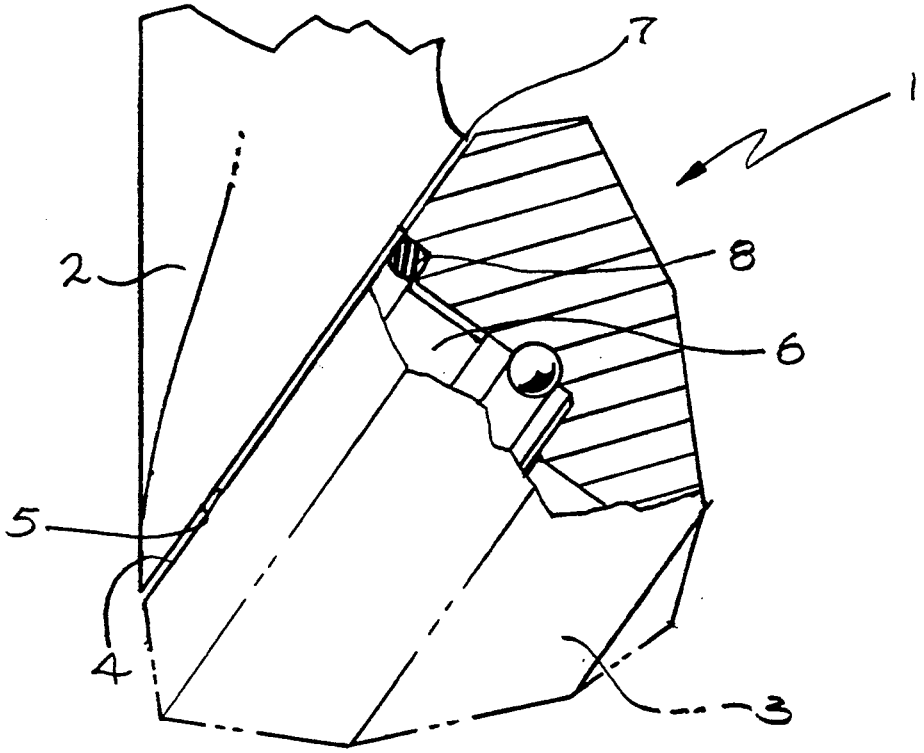
PRIOR ART FIG. 1
FIG. 1 is a partial cross section of a prior art sealed bearing rock bit roller cone mounted on a journal extending from the bit leg.

With reference to the prior art illustrated in FIG. 1, a sealed bearing roller cutter rock bit leg and cone assembly, generally designated as 1, shows a cone 3 rotatably mounted on a journal 6 cantilevered from a leg 2. The planar surface of leg backface 5 is opposed by the planar surface of the cone backface 4. The clearance 7 between these two surfaces is normally held to fairly close tolerances to help limit the axial movement of the cone 3 on the journal 6. This narrow annular space 7 tends to pack with shale cuttings and other debris, which then encroaches on the seal 8, ultimately destroying it. This allows drilling mud and abrasive drill cuttings to enter the bearing cavity thereby destroying the journal bearing and terminating the bit run.

Figure 2:
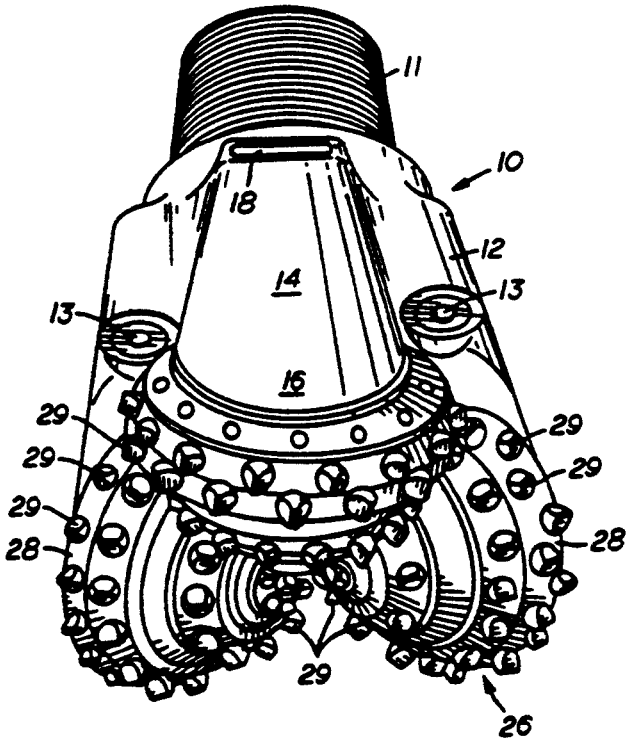
FIG. 2 is a perspective view of sealed bearing roller cone rock bit.

FIG. 2 depicts a sealed bearing rotary cone rock bit, generally designated as 10 that consists of a rock bit body 12, pin end 11 and a cutting end generally designated as 26. Each cone 28 making up cutting end 26 is attached to a leg 14. Each leg terminates in a shirttail portion 16. Each of the cones 28 has, for example, a multiplicity of strategically spaced tungsten carbide cutter inserts 29 interference fitted within insert holes formed in the cone bodies 28. A lubricant reservoir, generally designated as 18, is provided in each of the legs 14 to supply lubricant to bearing surface formed between the rotary cones and their respective journals. Three or more nozzles 13 communicate with a chamber formed inside the bit body 12 (not shown). The chamber receives drilling fluid or "mud" through the pin end 11. The fluid is then directed out through nozzles 13 during the drilling operation.

Figure 3:
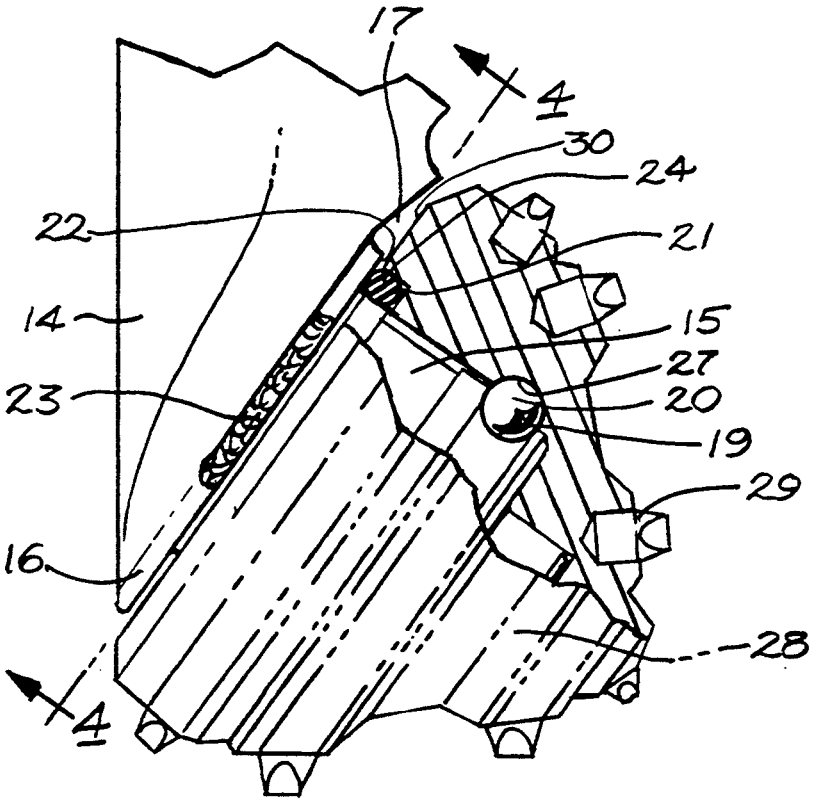
FIG. 3 is a partially broken away and sectioned view of the lower end of a leg of a rock bit illustrating a rotary cone mounted on a journal extending from the leg.

FIG. 3 illustrates a leg 14 of rock bit 10 with a cone 28 mounted on a journal 15. A plurality of cone retention balls 20 are confined within a bearing race 19 formed on journal 15 and a race 27 formed in cone 28. An o-ring 24 is retained within a seal gland 21 formed in the mouth of the cone 28. The o-ring 24 is confined in the seal gland 21 by the leg seal land 22. The o-ring seal 24 serves to retain lubricant within the bearing cavity between the cone 28 and the journal 15 and also serves to prevent drilling mud and detritus from entering the aforementioned bearing cavity. Leg 14 forms, at the cutting end 26 of the rock bit 10, a shirttail 16 and a leg backface 17. The leg backface 17 forms a circumferential passageway or groove 17 terminating at the lower edges of the shirttail 16. An arc of the groove 17 covers approximately 110° or more depending on the rock bit size and type. A cross section of the circumferential groove 17 has an arc as an inner boundary with an outer side being tangent to the arc at an angle of about 15° in reference to leg seal land 22. Although the cross-sectional geometry of groove or passageway 17 is essentially triangular, as shown in FIG. 3, it may have various geometries such as semi-circular, rectangular or others that fit within the space and strength constraints of bit leg 14. The circumferential groove 17 serves to supply a larger than normal volume of drilling fluid at the seal gland 21 to efficiently flush away shale or other drill cuttings to prevent these cuttings from adhering to the cone backface 30 of cone 28 before the cuttings can gain entrance to the seal gland 21.

Figure 4:
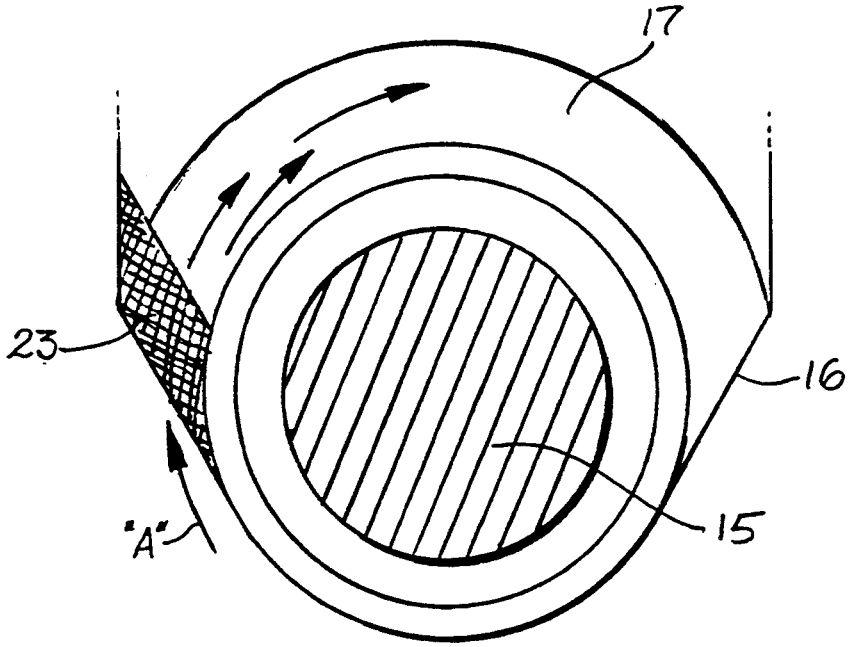
FIG. 4 is section 4—4 of FIG. 3 showing the backface of the bit leg.

FIG. 4 shows the leg backface groove 17 terminating at the bottom coincident with the lower margins of shirttail 16. Arrow "A" indicates the direction of rotation of the cone 28. The arrows in the groove 17 indicate the direction of drilling fluid flow through the groove. This fluid flow is enhanced by the rotation of cone 28. A hard, abrasion resistant cuttings or shale wiper pad 23 is shown fixedly positioned, by welding or other means, across the trailing end of the circumferential backface groove 17 in reference to the rotation direction of the cone 28. The detritus diverting pad can be formed of any material, that can be advantageously applied, having wear resistance greater than that of the parent metal substrate. The wiper pad material may be selected from the carbides of tungsten; titanium or tantalum or mixtures thereof. The angle of the wiper pad 23 across groove 17 is the angle that will make the trailing side of the pad 23 essentially tangent and coincident to the lower edge of the shirttail 16. The wiper pad 23 can have a width from about ⅛" to ¾" depending upon the abrasiveness of the rock being drilled and the bit size. The thickness of the pad 23 is as thick as possible without touching or rubbing the backface surface 30 of the rotating cone 28. The hard metal pad 23 wraps around the outer edge of the shirttail 16 to prevent the scraped abrasive cuttings from eroding away the base metal of the shirttail 16.

Field tests have shown that while the circumferential groove 17 alone and the shale diverter or scraper pad 23 alone will each show some decrease in shale or cuttings impaction (shale packing) of the seal gland 21, the use of a combination of the scraper pad 23 in conjunction with the circumferential groove 17 produces a marked improvement of drill cuttings exclusion with a significant increase in bit life.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A rotary cone rock bit apparatus to minimize the intrusion of detritus into the bearing cavity formed between a bearing and a rotary cone of said rock bit comprising;

a rock bit body having a first pin end and a second cutting end, at least one leg extends from said body toward said second cutting end, said leg rotatively supports said rotary cone from said bearing cantilevered from said leg, a leg backface formed by a shirttail formed at a base of the leg being positioned adjacent a cone backface formed by said rotatable cone, said leg backface in said shirttail forms an enlarged fluid passageway between the leg and the cone backface adjacent the bearing cavity, said enlarged passageway provides a means to allow fluid to flush said detritus from said bearing cavity during operation of said rock bit in an earthen formation.

2. The invention as set forth in claim 1 further comprising a hard material detritus diverting pad positioned in said leg backface portion of said shirttail completely across the passageway at a trailing edge formed at a trailing side relative to cone rotation of said shirttail, said pad being positioned immediately adjacent to said cone backface, said diverting pad serves to wipe away any accumulated detritus from the cone backface.

3. The invention as set forth in claim 2 wherein said hard material diverting pad is more wear resistant than a parent metal forming said leg backface.

4. The invention as set forth in claim 3 wherein said hard material for the diverting pad is selected from the group consisting of tungsten carbide, titanium carbide, tantalum carbide or mixtures thereof.

5. The invention as set forth in claim 1 wherein a cross-sectional geometry of the passageway is substantially triangular.

6. The invention as set forth in claim 1 wherein a cross-sectional geometry of the passageway is substantially semi-circular.

7. The invention as set forth in claim 1 wherein a cross-sectional geometry of the passageway is substantially rectangular.

8. A sealed bearing rotary cone rock bit apparatus to minimize the intrusion of detritus into the seal cavities formed between a bearing and a rotary cone of said rock bit comprising;

a rock bit body having a first pin end and a second cutting end, at least one leg extends from said body toward said second cutting end, said leg rotatively supports said rotary cone from said bearing cantilevered from said leg, a leg backface formed by a shirttail formed at a base of the leg being positioned adjacent a cone backface formed by said rotatable cone, said leg backface in said shirttail forms an enlarged fluid passageway between the leg and the cone backface adjacent the seal, said enlarged passageway provides a means to allow fluid to flush said detritus from said seal during operation of said rock bit in a earthen formation.

9. A method to minimize the intrusion of detritus into a bearing cavity formed between a bearing cantilevered from a leg of a rotary cone rock bit and a cone rotatively secured thereto comprising the steps of;

forming a passageway in a leg backface formed in a shirttail portion of the leg, said passageway providing an enlarged opening between a cone backface formed by said cone and said leg backface, said enlarged passageway allowing said detritus to be flushed from an entrance to said bearing cavity.

10. The method as set forth in claim 9 further comprising the step of applying a hardmetal material detritus diverting pad completely across the passageway at a trailing edge formed at a trailing side of said shirttail, and positioning said hardmetal pad immediately adjacent to said cone backface, said pad serving to wipe away any accumulated detritus from the cone backface.

11. The method as set forth in claim 10 further comprising the step of welding said hardmetal pad across said passageway.

12. A rotary cone rock bit apparatus to minimize the intrusion of detritus into the bearing cavity formed between a bearing and a rotary cone of said rock bit comprising;

a rock bit body having a first pin end and a second cutting end, at least one leg extends from said body toward said second cutting end, said leg rotatively supports said rotary cone from said bearing cantilevered from said leg, a leg backface formed by a shirttail formed at a base of the leg being positioned adjacent a cone backface formed by said rotatable cone, said shirttail having hardfacing material formed on a lower outer surface of said shirttail, a hard material detritus diverting pad positioned in said leg backface portion of said shirttail completely across a passageway formed between said leg backface and said cone backface, said pad blends into said hardfacing formed on said lower outer surface of said shirttail thereby preventing erosion and abrasion of the parent metal substrate of said leg while inhibiting intrusion of detritus into said seal cavity.

* * * * *